US006854442B2

(12) United States Patent
Satapathy et al.

(10) Patent No.: US 6,854,442 B2
(45) Date of Patent: Feb. 15, 2005

(54) ROTARY VALVE FOR CONTROLLING A FUEL INJECTOR AND ENGINE COMPRESSION RELEASE BRAKE ACTUATOR AND ENGINE USING SAME

(75) Inventors: Manas R. Satapathy, Hoffman Estates, IL (US); Scott R. Schuricht, Normal, IL (US)

(73) Assignee: Caterpillar Inc, Peoria, IL (US)

( * ) Notice: Subject to any disclaimer, the term of this patent is extended or adjusted under 35 U.S.C. 154(b) by 75 days.

(21) Appl. No.: 10/307,909

(22) Filed: Dec. 2, 2002

(65) Prior Publication Data

US 2004/0103878 A1 Jun. 3, 2004

(51) Int. Cl.[7] ..... F02D 13/04
(52) U.S. Cl. ..... 123/321; 123/446
(58) Field of Search ..... 123/321, 446; 137/625.41

(56) References Cited

U.S. PATENT DOCUMENTS

| | | | | |
|---|---|---|---|---|
| 3,710,908 | A | | 1/1973 | Muir |
| 4,158,348 | A | | 6/1979 | Mason et al. |
| 4,164,917 | A | | 8/1979 | Glasson |
| 4,510,900 | A | | 4/1985 | Quenneville |
| 4,592,319 | A | | 6/1986 | Meistrick |
| 4,664,070 | A | | 5/1987 | Meistrick et al. |
| 4,688,384 | A | | 8/1987 | Pearman et al. |
| 5,000,146 | A | | 3/1991 | Szucsanyi |
| 5,237,968 | A | | 8/1993 | Miller et al. |
| 5,309,881 | A | | 5/1994 | Pawellek et al. |
| 5,404,851 | A | | 4/1995 | Neitz et al. |
| 5,526,784 | A | | 6/1996 | Hakkenberg et al. |
| 5,626,116 | A | | 5/1997 | Reedy et al. |
| 5,738,075 | A | | 4/1998 | Chen et al. |
| 5,934,245 | A | | 8/1999 | Miller et al. |
| 5,957,106 | A | | 9/1999 | Maloney et al. |
| 6,374,806 | B1 | * | 4/2002 | Keeley et al. ..... 123/456 |
| 6,394,050 | B1 | * | 5/2002 | McCarthy et al. ..... 123/90.1 |
| 6,394,067 | B1 | * | 5/2002 | Usko et al. ..... 123/321 |

* cited by examiner

*Primary Examiner*—John T. Kwon
(74) *Attorney, Agent, or Firm*—Liell & McNeil

(57) ABSTRACT

The present invention relates to engines having multiple hydraulic devices. For instance, in a typical multi-cylinder diesel engine, each cylinder includes an intake valve, an exhaust valve, a fuel injector and an engine brake. It is common for each of these devices to be controlled by an individual actuator. However, engineers have learned that decreasing the number of engine components can increase engine robustness. Therefore, the present invention utilizes a single rotary actuator to control multiple hydraulic devices for an engine cylinder.

20 Claims, 5 Drawing Sheets

ROTARY VALVE FOR CONTROLLING A FUEL INJECTOR AND ENGINE COMPRESSION RELEASE BRAKE ACTUATOR AND ENGINE USING SAME

TECHNICAL FIELD

This invention relates generally to engines, and more particularly to valves for controlling hydraulically actuated fuel injectors and engine brakes.

BACKGROUND

In several diesel engines today, a number of hydraulically actuated devices, such as hydraulically actuated fuel injectors and engine compression release brakes, are coupled to each engine cylinder. Typically, each of these devices is controlled by an individual fluid control valve. For instance, hydraulically actuated fuel injectors such as that shown in U.S. Pat. No. 5,738,075 issued to Chen et al. on Apr. 14, 1998, include a solenoid driven fluid control valve that is attached to the injector body. The control valve controls fluid pressure to both an intensifier piston and a direct control needle valve included in the injector body. While fuel injectors, and other hydraulic devices, including individual fluid control valves have performed adequately, there is room for improvement. For instance, it is known in the art that a reduction in the number of engine components can make the engine more robust. Therefore, an engine including a single fluid control valve for each cylinder would find particular use in the industry.

The present invention is directed to overcoming one or more of the problems as set forth above.

SUMMARY OF THE INVENTION

In one aspect of the present invention, a hydraulic system has a rotary valve that has a valve body defining a plurality of passages. An electronic control module is in control communication with the rotary valve. A high pressure source is fluidly connected to one of the plurality of passages. A first hydraulic device and a second hydraulic device are fluidly connected to the rotary valve. The rotary valve has a first angular position in which the first hydraulic device is fluidly connected to the high pressure source. The rotary valve has a second angular position in which the second hydraulic device is fluidly connected to the high pressure source.

In another aspect of the present invention, an engine has an engine housing defining a plurality of cylinders and a rotary valve for each of the plurality of cylinders. An electronic control module is in control communication with the rotary valve. A first hydraulic device and a second hydraulic device for each of the plurality of cylinders are attached to the engine housing. A source of high pressure fluid is fluidly connected to the rotary valve. The rotary valve has a first angular position in which the first hydraulic device is fluidly connected to the source of high pressure fluid. The rotary valve has a second angular position in which the second hydraulic device is fluidly connected to the source of high pressure fluid.

In yet another aspect of the present invention, a method of controlling multiple hydraulic devices includes providing a rotary valve that has a valve body defining a high pressure passage. The rotary valve is placed in control communication with an electronic control module. The high pressure passage is fluidly connected to a high pressure fluid source. The rotary valve is fluidly connected to a first hydraulic device and a second hydraulic device. The rotary valve is rotated to a first angular position that fluidly connects the high pressure passage to the first hydraulic device. The rotary valve is then rotated to a second angular position fluidly connecting the high pressure passage to the second hydraulic device.

DETAILED DESCRIPTION

Figure 1:
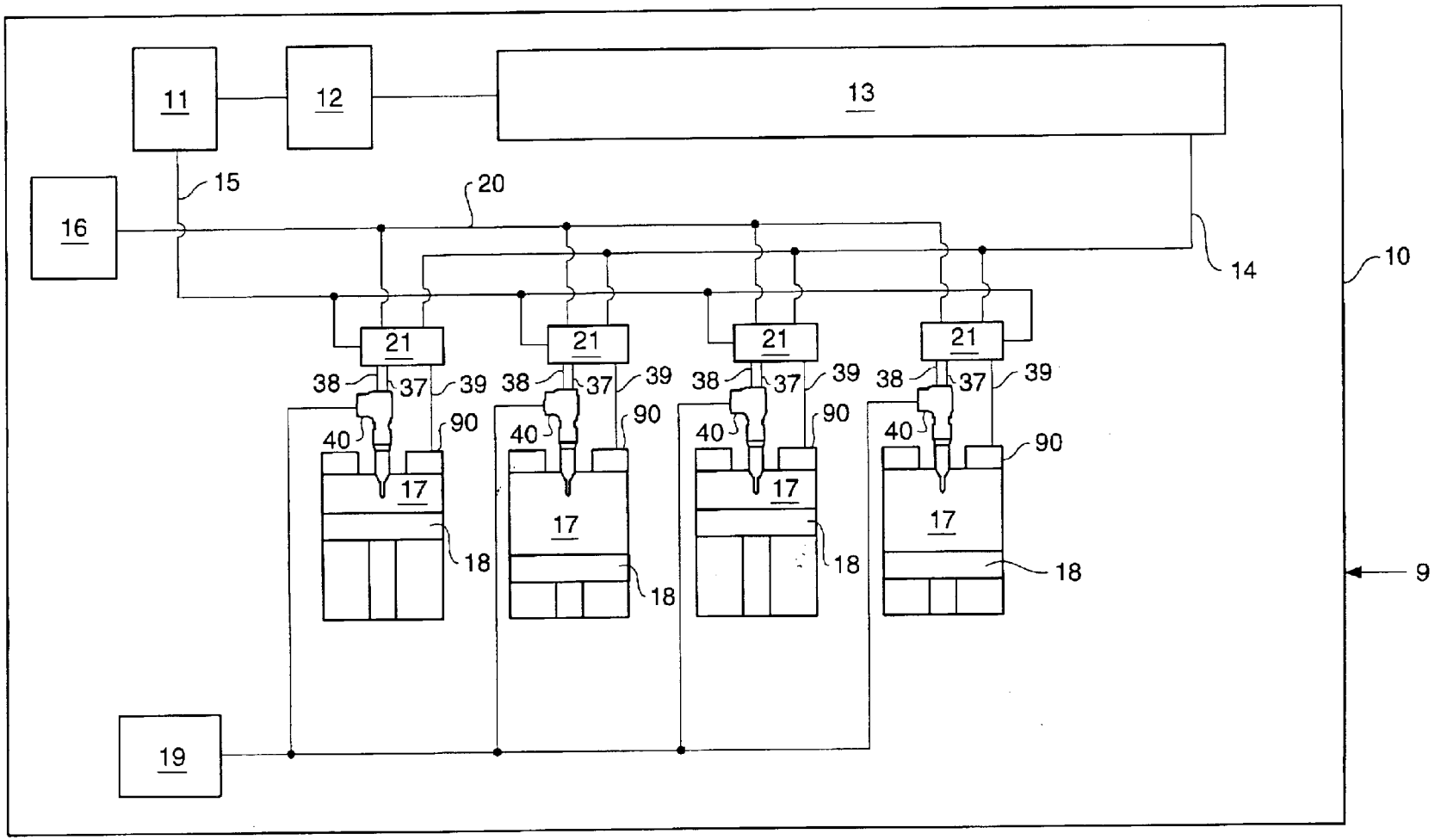
FIG. 1 is a schematic representation of an engine according to the present invention.

Referring to FIG. 1 there is shown an engine 9 according to the present invention. A low pressure reservoir 11 is provided in engine 9 and preferably includes an amount of low pressure engine lubricating oil. While low pressure reservoir 11 is preferably an oil pan that has engine lubricating oil, it should be appreciated that other fluid sources having an amount of available fluid, such as coolant, transmission fluid or fuel, could instead be used. A high pressure pump 12 pumps oil from low pressure reservoir 11 and delivers the same to high pressure manifold 13. High pressure oil flowing out of high pressure manifold 13 is delivered via high pressure fluid supply line 14 to a hydraulic system provided in engine 9 and oil is returned to low pressure reservoir 11 via low pressure return line 15 after it has performed work in the hydraulic system. Engine 9 also has an engine housing 10 that defines a plurality of cylinders 17.

Each of the cylinders 17 defined by engine housing 10 has a movable piston 18. Each piston 18 is movable between a retracted, downward position and an advanced, upward position. For a typical four cycle diesel engine 9, the advancing and retracting strokes of piston 18 correspond to the four stages of engine 9 operation. When piston 18 retracts from its top dead center position to its bottom dead center position for the first time, it is undergoing its intake stroke and air can be drawn into cylinder 17 via an intake valve. When piston 18 advances from its bottom dead center position to its top dead center position for the first time it is undergoing its compression stroke and air within cylinder 17 is compressed. At around the end of the compression stroke, fuel can be injected into cylinder 17 by fuel injector 40, and combustion within cylinder 17 can occur instantly, due to the high temperature of the compressed air. This combustion drives piston 18 downward toward its bottom dead center position, for the power stroke of piston 18. Finally, when piston 18 once again advances from its bottom dead center position to its top dead center position, post combustion products remaining in cylinder 17 can be vented via an exhaust valve, corresponding to the exhaust stroke of piston 18. While engine 9 has been illustrated as a four cycle, four-cylinder engine, it should be appreciated that any desired number of cylinders could be defined by engine housing 10.

Each cylinder 17 is operably connected to a number of hydraulically actuated devices. As illustrated in FIG. 1, these hydraulic devices are preferably a hydraulically actuated fuel injector 40 and an engine compression release brake 90. Fuel injector 40 is fluidly connected to a fuel tank 19 and delivers fuel to cylinder 17 for combustion while engine brake 90 controls release of compressed air from cylinder 17 when combustion is not desirable. A rotary valve 21 is fluidly connected to the fuel injector 40 and engine brake 90 of each cylinder. Rotary valve 21 can act as either a fluid switch or a pressure switch for fuel injector 40 and engine brake 90. Rotary valve 21 is controlled in operation by an electronic control module 16 via communication line 20.

Figure 2:
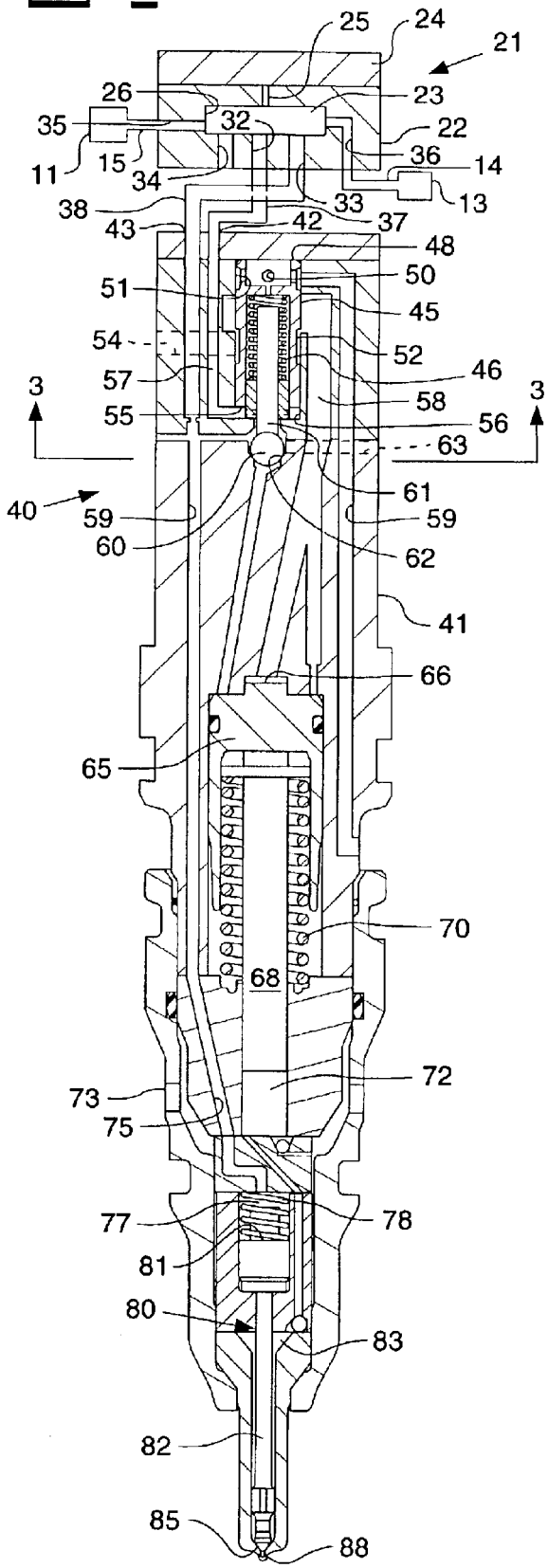
FIG. 2 is a sectioned side diagrammatic representation of a hydraulically actuated fuel injector fluidly connected to a rotary valve according to the present invention.
Figure 3:
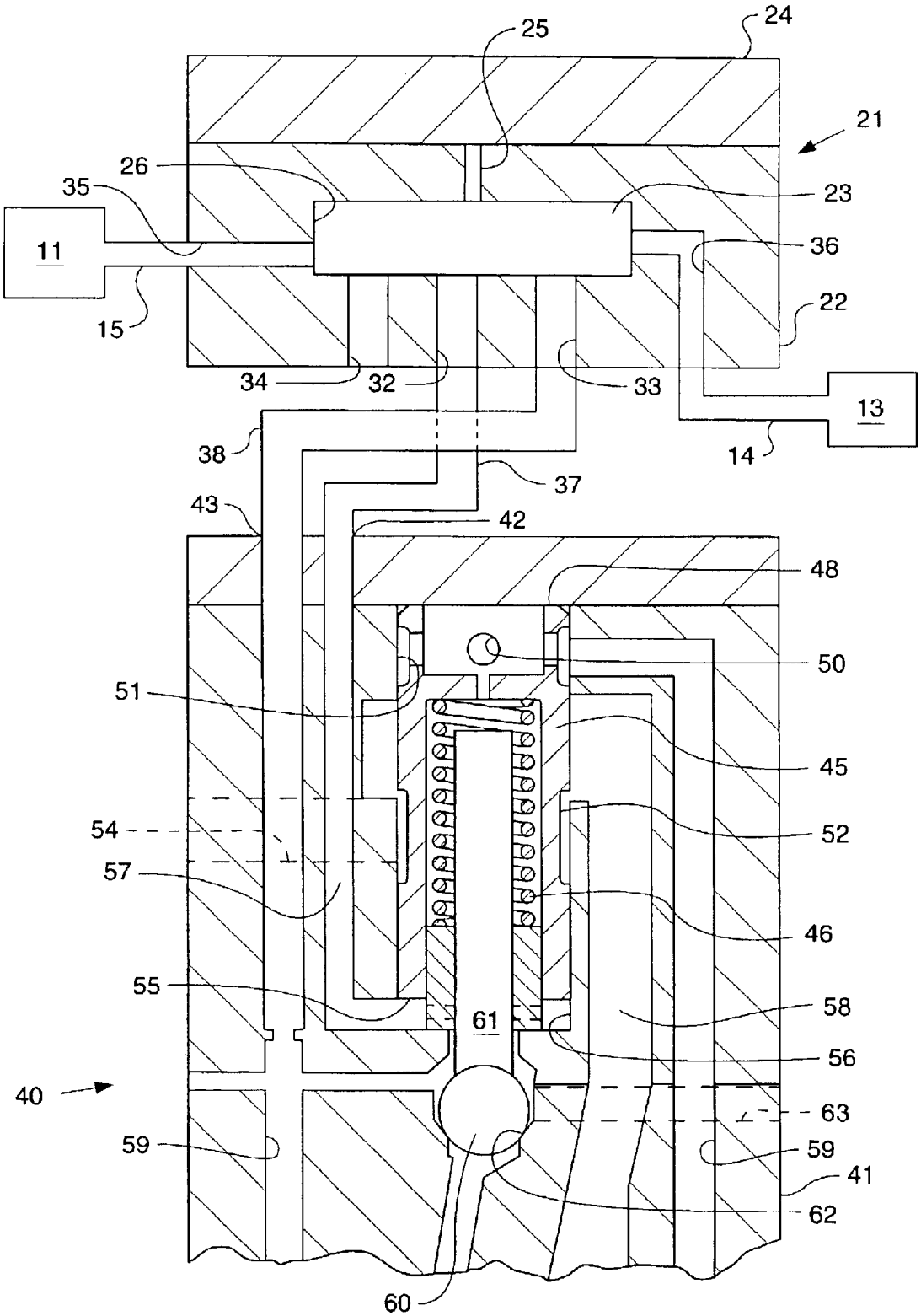
FIG. 3 is an enlarged sectioned view of the top portion of the fuel injector of FIG. 2.

Referring to FIGS. 2 and 3 there is shown a sectioned view through a fuel injector 40 fluidly connected to rotary valve 21. Rotary valve 21 has a valve body 22 that defines a rotary valve bore 26. A rotary actuator 24 of rotary valve 21 that is in control communication with electronic control module 16. Rotary actuator 24 is preferably a stepper motor but could be any suitable rotary activator. Rotary actuator 24 is connected to a rotary valve member 23 via an axial member 24. Valve body 22 also defines a high pressure passage 36 and a low pressure passage 35 that are fluidly connected to high pressure manifold 13 and low pressure reservoir 11, respectively. Depending on the angular position of valve member 23 within valve bore 26, high pressure passage 36 and low pressure passage 35 can be fluidly connected to one or more of a spool control passage 32, a needle control passage 33 and an engine brake control passage 34, all defined by valve body 22.

A spool communication passage 37 and a needle valve communication passage 38 fluidly connect rotary valve 21 to fuel injector 40. Fuel injector 40 has an injector body 41 with a spool valve member 45 that is movably positioned between an upward, retracted position and a downward, advanced position. Spool valve member 45 is biased toward its upward position, as shown, by a biasing spring 46. Spool valve member 45 has a high pressure annulus 51 that is always open to a high pressure passage 59 and is positioned such that it can open an actuation fluid passage 58 to high pressure passage 59 when spool valve member 45 is in its advanced position. A low pressure annulus 52 is also provided on spool valve member 45 that can connect actuation fluid passage 58 to a low pressure passage 54 defined by injector body 41 when spool valve member 45 is in its retracted position. Spool valve member 45 has a control surface 55 that is exposed to fluid pressure in a spool cavity 56, and a high pressure surface 48 that is continuously exposed to high pressure in high pressure passage 59 via a number of radial passages 50 defined by spool valve member 45. Spool cavity 56 is fluidly connected to a variable pressure passage 57 and a spool control inlet 42 that are defined by injector body 41. Variable pressure passage 57 is open to either low pressure reservoir 11 or high pressure manifold 13, via spool pressure communication passage 37 and spool control passage 32.

When variable pressure passage 57 is fluidly connected to high pressure manifold 13 by rotary valve 21, pressure within spool cavity 56 is high and spool valve member 45 is preferably hydraulically balanced and maintained in its upward position by biasing spring 46. When spool valve member 45 is in this position, actuation fluid passage 58 is blocked from fluid communication with high pressure passage 59 but fluidly connected to low pressure passage 54 via low pressure annulus 52. Conversely, when variable pressure passage 57 is fluidly connected to low pressure reservoir 11 by rotary valve 21, pressure within spool cavity 56 is sufficiently low that the high pressure acting on high pressure surface 48 can to overcome the force of biasing spring 46, and spool valve member 45 can move to its lower position. When spool valve member 45 is in this lower position, actuation fluid passage 58 is blocked from low pressure passage 54 but high pressure fluid can flow into actuation fluid passage 58 via high pressure annulus 51 and high pressure passage 59. Thus, rotary valve 21 acts as a pressure switch with respect to fuel injector 40, with no substantial flow volume therethrough.

Returning now to fuel injector 40, an intensifier piston 65 is movably positioned in injector body 41 and has a hydraulic surface 66 that is exposed to fluid pressure in actuation fluid passage 58. Piston 65 is biased toward a retracted, upward position by a biasing spring 70. However, when pressure within actuation fluid passage 58 is sufficiently high, such as when it is open to high pressure passage 59, piston 65 can move to an advanced, downward position against the action of biasing spring 70. A plunger 68 is also movably positioned in injector body 41 and moves in a corresponding manner with piston 65. When piston 65 is moved toward its advanced position, plunger 68 also advances and acts to pressurize fuel within a fuel pressurization chamber 72 that is connected to a fuel inlet 73 past a check valve 74. Fuel inlet 73 is in fluid communication with fuel source 19 via a fuel supply line 75. During an injection event as plunger 68 moves toward its downward position, check valve 74 is closed and plunger 68 can act to compress fuel within fuel pressurization chamber 72. When plunger 68 is returning to its upward position, fuel is drawn into fuel pressurization chamber 72 past check valve 74. Fuel pressurization chamber 72 is fluidly connected to a nozzle outlet 88 via a nozzle supply passage 83.

A pressure relief valve 60 is movably positioned in injector body 41 to vent pressure spikes from actuation fluid passage 58. Pressure spikes can be created when piston 65 and plunger 68 abruptly stop their downward movement due to the abrupt closure of nozzle outlet 88. Because pressure spikes can sometimes cause an uncontrolled and undesirable secondary injection due to an interaction of components and passageways over a brief instant after main injection has ended, a pressure relief passage 63 extends between actuation fluid passage 58 and a low pressure vent. When spool valve member 45 is in its downward position, such as during an injection event, a pin 61 holds pressure relief valve 60 downward to close a seat 62. When pressure relief valve 60 is in this position, actuation fluid passage 58 is closed to pressure relief passage 63 and pressure can build within actuation fluid passage 58. However, between injection events, when piston 65 and plunger 68 are hydraulically locked, residual high pressure in actuation fluid passage 58 can act against pressure relief valve 60. Because pressure within spool cavity 56 is high, spool valve member 45 is hydraulically balanced and can move toward its upward position under the action of biasing spring 46. Pressure relief valve 60 can then lift off of seat 62 to open actuation fluid passage 58 to pressure relief passage 63, thus allowing pressure within actuation fluid passage 58 to be reduced. At the same time, upward movement of pressure relief valve 60, and therefore pin 61 can aid in the movement of spool valve member 45 toward its upward position.

Returning to fuel injector 40, a direct control needle valve 80 is positioned in injector body 41 and has a needle valve member 82 that is movable between a first position, in which a nozzle outlet 88 is open, and a downward second position in which nozzle outlet 88 is blocked. Needle valve member 82 is mechanically biased toward its downward closed position by a biasing spring 78. Needle valve member 82 has an opening hydraulic surface 85 that is exposed to fluid pressure within a nozzle chamber 84 and a closing hydraulic surface 81 that is exposed to fluid pressure within a needle control chamber 77. A pressure communication passage 76 is in fluid communication with needle control chamber 77 and controls fluid pressure within the same. Pressure communication passage 76 is in fluid communication with rotary valve 21 via a needle valve control inlet 43 defined by injector body 41 and needle valve communication passage 38. Depending on the angular position of valve member 23 within valve bore 26, needle control chamber 77 can be fluidly connected to either high pressure manifold 13 or low pressure reservoir 11 via needle control passage 33.

Closing hydraulic surface 81 and opening hydraulic surface 85 are preferably sized such that even when a valve opening pressure is attained in nozzle chamber 84, needle valve member 82 will not lift open when needle control chamber 77 is fluidly connected to high pressure manifold 13 via rotary valve 21 and pressure communication passage 76. However, it should be appreciated that the relative sizes of closing hydraulic surface 81 and opening hydraulic surface 85 and the strength of biasing spring 78 should be such that when closing hydraulic surface 81 is exposed to low pressure in needle control chamber 77, the high pressure acting on opening hydraulic surface 85 should be sufficient to move needle valve member 82 upward against the force of biasing spring 78 to open nozzle outlet 88.

Figure 4:
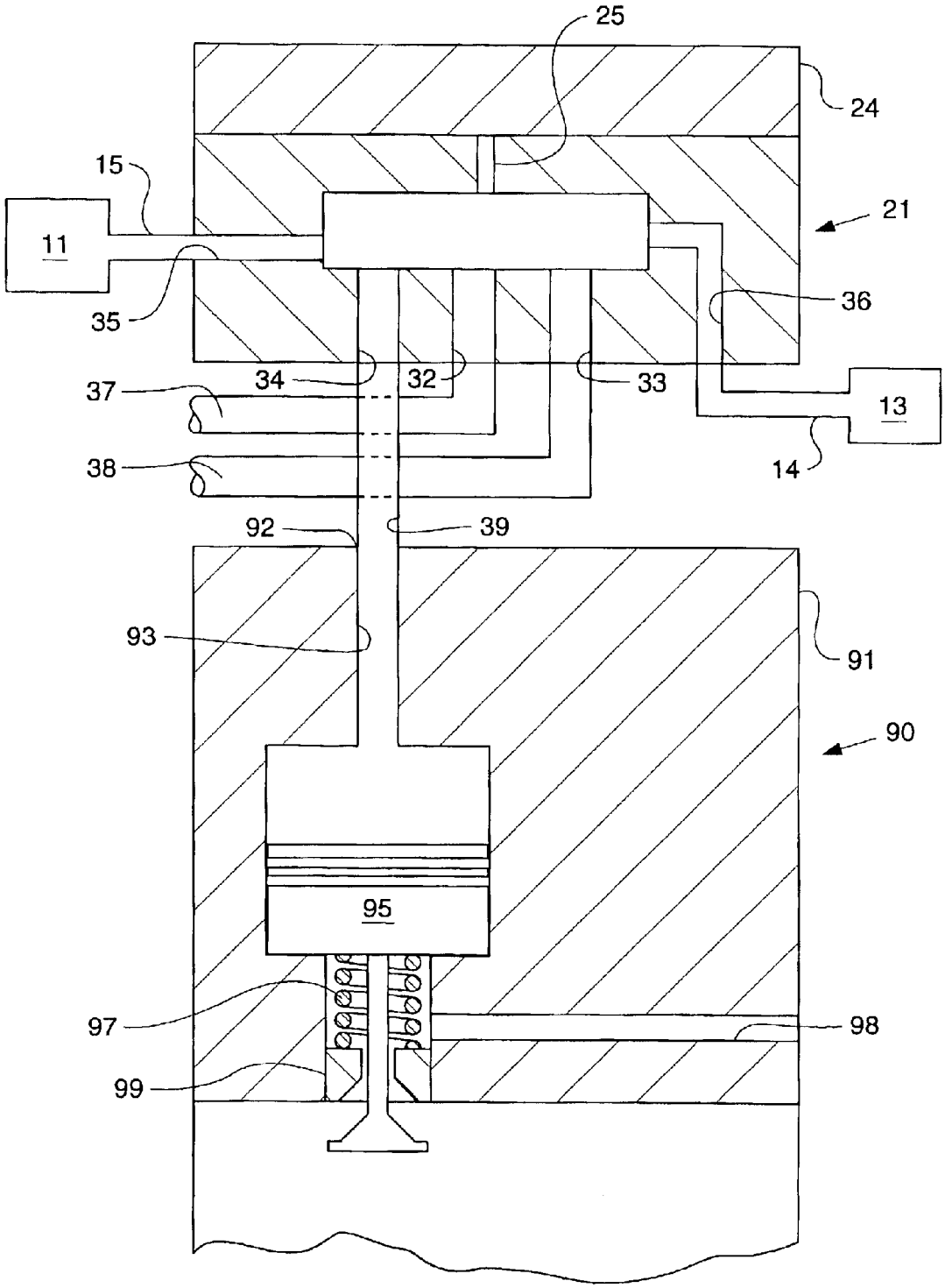
FIG. 4 is sectioned side diagrammatic representation of an engine compression release brake fluidly connected to a rotary valve according to the present invention.

Referring now to FIG. 4, there is shown an engine brake 90 fluidly connected to rotary valve 21 according to the present invention. Engine brake 90 is preferably any engine brake that is positioned in engine 9 to vent compressed air within cylinder 17 toward the end of the compression stroke of piston 18. It is known in the art that injection and combustion are not always necessary, or desirable, during each cycle of piston 18. One such time might be when a vehicle having engine 9 is descending a relatively steep hill. During the descent, injection and combustion are not necessary and instead braking is often desirable. To increase efficiency of engine 9, and to decrease undesirable emissions created during unnecessary combustion, an engine brake, such as engine brake 90, is preferably operably coupled to each cylinder 17 of engine 9. When combustion is not desired, fuel is not injected into cylinder 17 at the end of the compression stroke, but instead, the compression of air in cylinder 17 during the compression stroke provides braking power for engine 9. This energy is released by engine brake 90 instead of being recovered as piston 18 retracts toward its downward position.

Returning to engine 9 and engine brake 90, as illustrated, rotary valve 21 functions as a flow control valve for engine brake 90. Engine brake 90 has an engine brake body 91 that defines a fluid passage 93 and an engine brake control inlet 92. Engine brake control inlet 92 and fluid passage 93 are fluidly connected to either high pressure manifold 13 or low pressure reservoir 11 via an engine brake control passage 34 defined by rotary valve 21 and an engine brake communication passage 39. A hydraulic actuator, piston 95, is positioned in engine brake body 91 and is movable between a retracted, upward position and an advanced, downward position. It should be appreciated that in addition to the hydraulic actuator provided in engine brake 90, the exhaust valve for cylinder 17 could also have a conventional actuator that is coupled to the cam shaft.

Piston 95 is biased toward its retracted position by a biasing spring 97. When fluid passage 93 is fluidly connected to low pressure reservoir 11, piston 95 remains in its retracted position, and engine brake 90 is deactivated to prevent venting of exhaust from engine cylinder 17. However, when fluid passage 93 is fluidly connected to high pressure manifold 13, piston 95 is moved to its advanced position toward a seat component 99 against the action of biasing spring 97, and engine brake 90 can open cylinder 17 to an exhaust passage 98. While rotary valve 21 has been illustrated to function as a flow control valve for engine brake 90, it should be appreciated that rotary valve 21 could instead function as a pressure switch for engine brake 90. In that case, the top portion of engine brake 90 could be substantially similar to the top portion of fuel injector 40, as illustrated in FIG. 3. For instance, in that case engine brake 90 could have a spool valve, such as spool valve 45, that controls pressure above piston 95.

Figure 5:
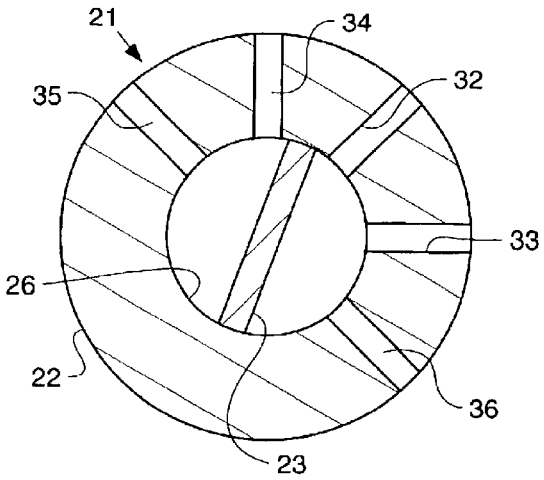
FIG. 5 is a sectioned top diagrammatic representation of a rotary valve member in a first position according to the present invention.

Referring to FIGS. 5–8, rotary valve 21 has been shown with valve member 23 in each of its four angular positions. Recall that rotary valve 21 is acting as a pressure switch for fuel injector 40 and as a fluid switch for engine brake 90. It should be appreciated that if rotary valve 21 were acting in a different capacity for either one or both of these hydraulic devices, the angular positions of valve member 23 would correspond to the connection of different passages within fuel injector 40 and engine brake 90 to high pressure source 13 and low pressure reservoir 11. As illustrated in FIG. 5, when rotary valve 21 is in its first angular position, engine brake control passage 34 is open to low pressure passage 35, while spool control passage 32 and needle control passage 33 are fluidly connected to high pressure passage 36. When valve member 23 is in this position, fluid passage 93 of engine brake 90 is open to low pressure reservoir 11 while variable pressure passage 57 and pressure communication passage 76 are open to high pressure manifold 13. In other words, when rotary valve 21 is in this angular position, engine brake 90 is deactivated and fuel injector 40 is between fuel injection events.

Figure 6:
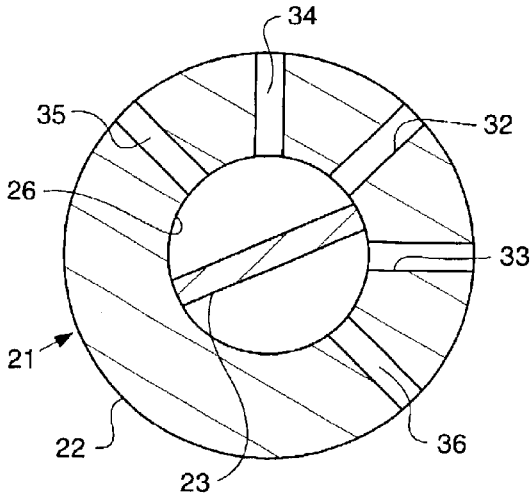
FIG. 6 is a sectioned top diagrammatic representation of the rotary valve member of FIG. 6 in a second position.

As illustrated in FIG. 6, when rotary valve member 23 is in its second position, both engine brake control passage 34 and spool control passage 32 are open to low pressure reservoir 11, while needle control passage 33 is open to high pressure manifold 13. Fluid passage 93 remains fluidly connected to low pressure reservoir 11, while variable pressure passage 57 is now blocked from high pressure manifold 13 and opened to low pressure reservoir 11. When valve member 23 is in this position, pressure communication passage 76 remains open to high pressure manifold 13. Therefore, engine brake 90 remains deactivated, while fuel injector 40 can prepare for fuel injection. In other words, spool valve member 45 can move toward its downward position to connect actuation fluid passage 58 to high pressure passage 59. High pressure acting on hydraulic surface 66 can move piston 65 toward its downward position to allow fuel within fuel pressurization chamber 72 to be raised to injection pressure levels.

Figure 7:
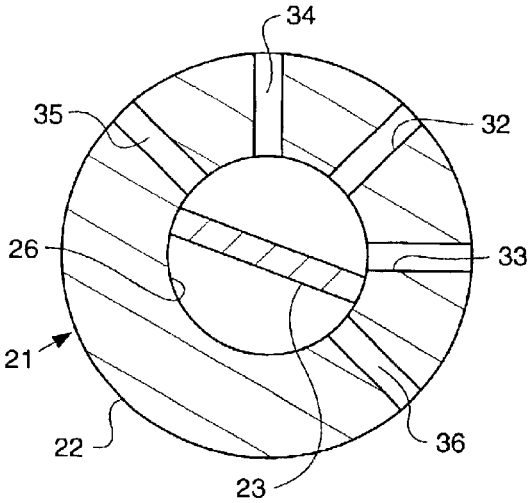
FIG. 7 is a sectioned top diagrammatic representation of the rotary valve member of FIG. 6 in a third position.

As illustrated in FIG. 7, when rotary valve member 23 is in its third position, engine brake control passage 34, spool control passage 32 and needle control passage 33 are all open to low pressure reservoir 11 via low pressure passage 35. This corresponds to engine brake 90, variable pressure passage 57 and pressure communication passage 76 being fluidly connected to low pressure reservoir 11. When rotary valve member 23 is in this position, engine brake 90 remains deactivated. However, because pressure communication passage 76 is now open to low pressure reservoir 11, low pressure can act on closing hydraulic surface 81. The fuel pressure in nozzle supply passage 83 is now sufficient to lift needle valve 82 and fuel can be injected from fuel injector 40.

Figure 8:
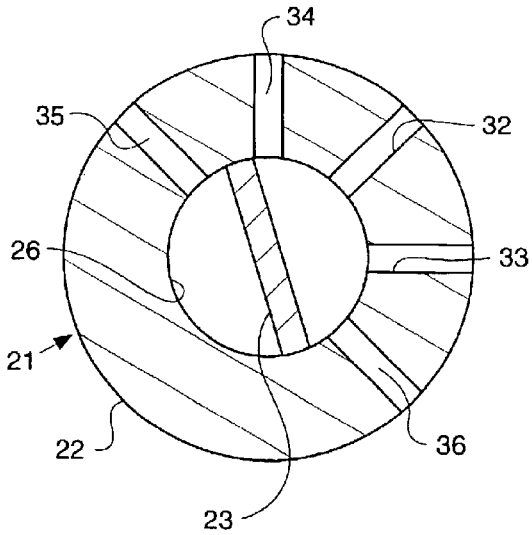
FIG. 8 is a sectioned top diagrammatic representation of the rotary valve member of FIG. 6 in a fourth position.

As illustrated in FIG. 8, when rotary valve member 23 is in its fourth position, engine brake control passage 34, spool control passage 32 and needle control passage 33 are all open to high pressure manifold 13 via high pressure passage 36. When rotary valve member 23 is in this position, piston 95 is exposed to high pressure in fluid passage 93 and can move toward its advanced position to open cylinder 17 to engine passage 98. However, because pressure communication passage 76 is also open to high pressure, needle valve 82 is prohibited from lifting toward its upward position to open nozzle outlet 88. Further, because variable pressure passage 57 is open to high pressure, spool valve member 45 can move toward its upward position, to close actuation fluid passage 58 from high pressure passage 59, thus allowing piston 65 and plunger 68 to retract.

INDUSTRIAL APPLICABILITY

Referring to FIGS. 1–8, operation of the present invention will be discussed for one engine cylinder. It should be appreciated that while different cylinders are operating at different stages of their intake-compression-power-engine cycles at one time, the present invention operates in the same manner for each cylinder. Recall, in addition, that the rotary valve 21 of the present invention is being described for use with a four cylinder, four cycle engine 9. However, it should be appreciated that rotary valve 21 would find application in engines having a different number of cylinders or for those with cylinders operating under a different number of cycles. In addition, while rotary valve 21 has been illustrated as a flow control valve for engine brake 90 and a pressure switch for fuel injector 40, it should be appreciated that it could function as a pressure switch to control other valves for cylinder 17. Similarly, rotary valve 21 could function as a flow control device to directly control activation of hydraulic devices in engine 9.

Prior to the intake stage for cylinder 17, valve member 23 is in its first angular position such that fluid passage 93 of engine brake 90 is fluidly connected to low pressure reservoir 11. Low pressure is therefore acting on piston 95, such that engine brake 90 is in an off condition and cylinder 17 is closed to exhaust passage 98. At the same time, variable pressure passage 57 and pressure communication passage 76 are fluidly connected to high pressure manifold 13. When valve member 23 is in this position, spool valve member 45 is in its upward position opening actuation fluid passage 58 to low pressure passage 54 such that piston 65 and plunger 68 are in their upward positions. Additionally, because closing hydraulic surface 81 is exposed to high pressure in needle control chamber 77 and pressure communication passage 76, needle valve member 82 is held in its downward position to close nozzle outlet 88. As engine piston 18 moves downward toward its bottom position it draws air into cylinder 17 via the intake valve. Upon reaching its bottom dead center position, the intake stroke is ended and piston 18 begins to advance toward its upward position to compress the air that has been drawn into cylinder 17. Preferably, it is during this advancing movement of piston 18 that electronic control module 16 determines if fuel injection will be desirable at the end of the compression stroke. If it is, rotary actuator 24 rotates axial member 25 to move rotary valve member 23 to its second angular position to prepare fuel injector 40 for fuel injection. However, it should be appreciated that this determination could be made at any suitable time prior to the end of the compression stroke of piston 18.

When valve member 23 moves to its second angular position, fluid passage 93 remains fluidly connected to low pressure reservoir 11, such that engine brake 90 will not vent the contents of cylinder 17. In addition, pressure communication passage 76 remains fluidly connected to high pressure manifold 13 to prevent needle valve member 82 from opening nozzle outlet 88 to the combustion space. However, when valve member 23 is in this position, variable pressure passage 57 is blocked from fluid communication with high pressure manifold 13 and opened to low pressure reservoir 11. Pressure within spool cavity 56 is now reduced and spool valve member 45 can move toward its downward position due to the high pressure acting on high pressure surface 48. When spool valve member 45 advances, actuation fluid passage 58 becomes blocked from low pressure passage 54 and opened to high pressure passage 59 via high pressure annulus 51. High pressure is now acting on hydraulic surface 66 causing piston 65 and plunger 68 to start moving toward their advanced positions to pressurize fuel in fuel pressurization chamber 72 and nozzle chamber 84. However, because closing hydraulic surface 81 is exposed to high pressure in needle control chamber 77, needle valve member 82 will not be moved to its upward position to open nozzle outlet 88. Further, it should be appreciated that piston 65 and plunger 68 move only a slight distance at this time because of hydraulic locking, which is a result of nozzle outlet 88 remaining closed. However, the slight movement of piston 65 and plunger 68 is still sufficient to raise fuel pressure within fuel pressurization chamber 72 to injection pressure levels.

Just prior to the desired start of injection, when piston 18 is near its top dead center position to end the compression stroke, rotary valve member 23 is moved to its third angular position by rotary actuator 24. Fluid passage 93 remains fluidly connected to low pressure reservoir 11 to prevent engine brake 90 from venting the contents of cylinder 17. In addition, variable pressure passage 57 remains fluidly connected to low pressure reservoir 11 such that spool valve member 45 remains in its upward, retracted position fluidly connecting actuation fluid passage 58 to high pressure passage 48. However, pressure communication passage 76 is now fluidly connected to low pressure reservoir via rotary valve 21 to expose needle control chamber 77 to low pressure. Because high pressure is no longer acting on closing hydraulic surface 81, the fuel pressure in nozzle chamber 84 is sufficient to overcome the bias of biasing spring 78 and needle valve member 82 moves to its open position to allow fuel injection into cylinder 17. As previously discussed, this fuel injection from injector 40 is timed to coincide with the end of the compression stroke of piston 18. When fuel is injected into cylinder 17, it ignites instantly due to the high temperature of the compressed air within cylinder 17. This combustion drives piston 18 downward for its power stroke.

Returning to fuel injector 40, when the desired amount of fuel has been injected into cylinder 17, rotary valve member 23 is returned to its first angular position to allow the various components of fuel injector 40 to reset themselves in preparation for the next injection event. Variable pressure passage 57 becomes blocked from fluid communication with low pressure reservoir 11 and is opened to high pressure manifold 13. The high pressure acting on closing hydraulic surface 81 is sufficient to move needle valve 82 downward to close nozzle outlet 88 and end injection. Because of hydraulic locking, piston 65 and plunger 68 stop their advancing movement, but do not immediately being to retract because of residual high pressure acting on hydraulic surface 66. At this time, control surface 55 is exposed to high pressure within spool cavity 56, and spool valve member 45 once again becomes hydraulically balanced and begins to move toward its upward position under the action of biasing spring 46. Residual high pressure in actuation fluid passage 58 is sufficient to move pressure relief valve 60 upward away from seat 62 to fluidly connect actuation fluid passage 58 to pressure relief passage 63. Pressure relief valve 60 can therefore help vent high pressure actuation fluid from actuation fluid passage 58 to prevent pressure spikes from causing undesired secondary injections. At the same time, the upward movement of pressure relief valve 60 causes pin 61 to aid spool valve member 45 in returning to its upward position.

Once actuation fluid passage 58 is opened to pressure relief passage 63, pressure within actuation fluid passage 58 is reduced and piston 65 and plunger 68 can return to their upward positions. In addition, once spool valve member 45 is returned to its upward position, actuation fluid cavity is blocked from fluid communication with high pressure passage 59 and fluidly connected to low pressure passage 54, which further reduces the pressure within actuation fluid passage 58. As plunger 68 retracts, fuel from fuel source 19 can be drawn into fuel pressurization chamber 72 via fuel inlet 73 past check valve 74. As the components of fuel injector 40 are resetting themselves, piston 18 is advancing toward its top dead center position for its exhaust stroke to vent any residue from injection out of cylinder 17 via the exhaust valve.

During a typical engine cycle, once piston 18 reaches the bottom dead center position for its power stroke, it begins to advance again for the exhaust stroke of the cylinder cycle. In other words, the exhaust valve is opened for the duration of the movement of piston 18 from its bottom dead center position to its top dead center position, and post combustion products remaining in cylinder 17 can be vented. In addition to exhaust during this portion of the engine cycle, it is sometimes desirable to vent the compressed air from cylinder 17 at the end of the compression stroke using engine brake 90. During these conditions, when piston 18 is advancing toward the top dead center position of its compression stroke, electronic control module 16 determines that fuel injection is not desirable, and instead engine brake 90 should be activated. Rotary valve member 23 is then moved to its fourth angular position by axial member 25, rather than its second or third position as described above. When valve member 23 is in this position, variable pressure passage 57 and pressure communication passage 76 remain fluidly connected to high pressure manifold 13. However, fluid passage 93 of engine brake 90 becomes fluidly connected to high pressure manifold 13 via rotary valve 21. With fluid passage 93 now open to high pressure manifold 13, piston 95 can advance against the bias of biasing spring 97, and engine brake 90 can vent the contents of cylinder 17. Once the compressed air has been vented from cylinder 17, rotary valve member 23 can return to its first angular position to open fluid passage 93 to low pressure reservoir 11, exposing piston 95 to low pressure and allowing the same to return to its retracted position under the action of biasing spring 97 to close the exhaust port. Rotary valve member 23 is now ready to return to its first angular position.

It should be appreciated that a number of modifications could be made to the present invention. For instance, while engine brake control passage 34 has been illustrated as a fluid supply passage, it could instead be a pressure communication passage, like spool control passage 32 and needle control passage 33. In that instance, engine brake 90 would have a control valve, such as spool valve member 45, positioned in fuel injector 40. Engine brake control passage 34 would be positioned in a different location with respect to low pressure passage 35 and high pressure passage 36 for engine brake 90 to function properly. In other words, engine brake control passage 34 would need to be defined by valve body 22 such that it is fluidly connected to high pressure passage 36 when valve member 23 is in its first, second and third positions. This would allow a spool valve member, such as spool valve member 45, to remain in its retracted position blocking an actuation fluid passage from communication with a high pressure passage. When valve member 23 is in its fourth position, engine brake control passage 34 would be open to low pressure passage 35, such that the spool valve member could advance. In addition to the change in the orientation of engine brake control passage 34 with respect to high pressure passage 36 and low pressure passage 35, it should be appreciated that the size of engine brake control passage 34 could also be modified. For instance, when rotary valve 21 is acting as a flow control valve, as illustrated herein, engine brake control passage 34 must be large enough for a sufficient amount of fluid to flow into fluid passage 93 to move piston 95 toward its downward position when it is connected to high pressure passage 36. However, if rotary valve 21 were acting as a pressure switch, engine brake control passage 34 could be smaller in diameter and still communicate a sufficient amount of pressure to engine brake 90 to allow it to function as desired.

The present invention could also be modified to allow rotary valve 21 to replace both the fuel injector pilot valve member, as well as spool valve member 45. In this modification, spool communication passage 37 would be replaced by a piston communication passage that is fluidly connected to actuation fluid passage 58. Spool control passage 32, defined by valve body 22, would be replaced by a piston control passage oriented with respect to low pressure passage 35 and high pressure passage 36 such that piston 65 would function as desired. Unlike spool control passage 32, which is a pressure communication passage, the piston control passage would be a fluid communication passage. In this instance, when valve member 23 is in its first position, the piston control passage would be exposed to low pressure passage 35, such that piston 65 remains in its upward, retracted position. When valve member 23 is in its second and third position, the piston control passage would be open to high pressure passage 36 such that high pressure would act on hydraulic surface 66 of piston 65 to move the same toward its advanced position to aid in the pressurization of fuel within fuel pressurization chamber 72. Finally, when valve member 23 is in its fourth position, the piston control passage would be reopened to low pressure passage 35 to allow piston 65 and plunger 68 to return to their retracted positions in preparation for the next injection event.

In addition to these modifications, it should be appreciated that still further modifications could be made to rotary valve 21 and engine 9. For instance, rotary valve 21 could be used to replace the poppet valve in a HEUI-A fuel injector, as described in U.S. Pat. No. 5,713,520 issued to Glassey et al. on Feb. 3, 1998. Rotary valve 21 would function as described above for replacement of both the control valve and the spool valve of a HEUI-B injector. In addition, rotary valve 21 could also be modified to control the intake valve for cylinder 17, in addition to controlling fuel injector 40 and engine brake 90. This would find particular application in a camless engine in which exhaust, intake and injection are all hydraulically actuated by a single rotary valve for each cylinder. It should be appreciated that a single rotary valve, such as rotary valve 21, can control all of these aspects of engine function because exhaust, braking, intake and injection all occur at different times during the engine cycle.

The rotary valve of the present invention provides advantages over engines and hydraulic systems that do not utilize such a valve for control of their hydraulic devices. For instance, because the number of fluid control valves has been reduced, the engine can be more robust. Utilization of a single control valve to control the hydraulic devices for the cylinder can reduce problems associated with timing, because there is no need to coordinate the operation of multiple devices. For instance, because a single control valve is controlling both the fuel injector and the engine brake, these devices cannot be activated at the same time. Further, the smaller the number of working components within the engine, the smaller the number of components that can fail during engine operation.

It should be understood that the above description is intended for illustrative purposes only, and is not intended to limit the scope of the present invention in any way. For instance, while the rotary valve of the present invention has been illustrated as controlling only an engine brake and a hydraulically actuated fuel injector, it should be appreciated that it could additionally control an intake valve for the cylinder. Further, while the rotary valve has been illustrated controlling a fuel injector having a spool valve that controls fluid pressure in the actuation fluid cavity, it should be appreciated that the rotary valve could replace both the pilot valve and the spool valve for a HEUI-A fuel injector, as illustrated herein. It should be appreciated that the spool control outlet of the rotary valve would be replaced with a piston control outlet, and further that this outlet would be connected to high or low pressure at different times than the spool control outlet. Thus, those skilled in the art will appreciate that other aspects and features of the present invention can be obtained from a study of the drawings, the disclosure, and the appended claims.

What is claimed is:

1. A hydraulic system comprising:

a rotary valve including a valve body that defines a plurality of passages;

an electronic control module being in control communication with said rotary valve;

a high pressure source being fluidly connected to one of said plurality of passages;

a first hydraulic device and a second hydraulic device being fluidly connected to said rotary valve;

said rotary valve having a first angular position in which said first hydraulic device is fluidly connected to said high pressure source; and said rotary valve having a second angular position in which said second hydraulic device is fluidly connected to said high pressure source.

2. The hydraulic system of claim 1 wherein said first hydraulic device is a hydraulically actuated fuel injector.

3. The hydraulic system of claim 1 wherein said second hydraulic device is an engine brake actuator.

4. The hydraulic system of claim 1 wherein said first hydraulic device is a direct control needle valve for a fuel injector.

5. The hydraulic system of claim 4 wherein said fuel injector defines a first fluid passage and a second fluid passage;

said first fluid passage and said second fluid passage are fluidly connected to said high pressure source when said rotary valve is in said first angular position and said second angular position; and said rotary valve having a third angular position in which said first fluid passage is blocked from said high pressure source and said second fluid passage is fluidly connected to said high pressure source.

6. The hydraulic system of claim 1 including a low pressure reservoir fluidly connected to a second one of said plurality of passages;

said first hydraulic device being blocked from fluid communication with said low pressure reservoir when said rotary valve is in said second angular position; and said second hydraulic device being fluidly connected to said low pressure reservoir when said rotary valve is in said first angular position.

7. The hydraulic system of claim 1 including a low pressure reservoir fluidly connected to a second one of said plurality of passages; and said rotary valve member having a third angular position in which said first hydraulic device and said second hydraulic device are fluidly connected to said low pressure reservoir.

8. The hydraulic system of claim 1 including a low pressure reservoir fluidly connected to a second one of said plurality of passages;

said second hydraulic device defining a third fluid passage; and said rotary valve member having a third angular position in which said first fluid passage and said third fluid passage are fluidly connected to said low pressure reservoir and said second fluid passage is fluidly connected to said high pressure source.

9. An engine comprising:

an engine housing defining a plurality of cylinders;

a rotary valve for each of said plurality of cylinders attached to said engine housing;

an electronic control module being in control communication with said rotary valve;

a first hydraulic device and a second hydraulic device for each of said plurality of cylinders being attached to said engine housing;

a source of high pressure fluid being fluidly connected to said rotary valve;

said rotary valve having a first angular position in which said first hydraulic device is fluidly connected to said source of high pressure fluid; and said rotary valve having a second angular position in which said second hydraulic device is fluidly connected to said source of high pressure fluid.

10. The engine of claim 9 including a low pressure reservoir fluidly connected to said rotary valve; and said second hydraulic device being fluidly connected to said low pressure reservoir when said rotary valve is in said first angular position.

11. The engine of claim 10 wherein said first hydraulic device is a fuel injector including an injector body that defines a first fluid passage and a second fluid passage;

said first fluid passage and said second fluid passage are fluidly connected to said high pressure source when said rotary valve is in said first angular position and said second angular position; and said rotary valve having a third angular position in which said first fluid passage is blocked from said high pressure source and said second fluid passage is fluidly connected to said high pressure source.

12. The engine of claim 11 wherein said second hydraulic device is an engine brake actuator.

13. The engine of claim 12 wherein said engine brake actuator defines an engine brake fluid passage; and said rotary valve has a fourth angular position in which said first fluid passage, said second fluid passage and said engine brake fluid passage are fluidly connected to said low pressure reservoir.

14. The engine of claim 13 wherein a direct control needle valve is movably positioned in said injector body and includes a closing hydraulic surface that is exposed to fluid pressure in said second fluid passage.

15. The engine of claim 13 wherein said rotary valve includes a valve body that defines a high pressure passage in fluid communication with said high pressure source and a low pressure passage in fluid communication with said low pressure reservoir.

16. A method of controlling multiple hydraulic devices attached to an engine comprising:

providing a rotary valve including a valve body that defines a high pressure passage;

placing said rotary valve in control communication with an electronic control module;

fluidly connecting said high pressure passage to a high pressure fluid source;

fluidly connecting said rotary valve to a first hydraulic device and a second hydraulic device;

rotating said rotary valve to a first angular position fluidly connecting said high pressure passage to said first hydraulic device; and rotating said rotary valve to a second angular position fluidly connecting said high pressure passage to said second hydraulic device.

17. The method of claim 16 wherein said valve body defines a low pressure passage; and including the step of fluidly connecting said low pressure passage to said low pressure reservoir.

18. The method of claim 17 wherein said first hydraulic device is a fuel injector including an injector body that defines a first fluid passage and a second fluid passage; and including a step of rotating said rotary valve to a third angular position fluidly connecting said first fluid passage to said low pressure reservoir and said second fluid passage to said high pressure source.

19. The method of claim 18 including rotating said rotary valve to a fourth angular position in which said fuel injector and said second hydraulic device are fluidly connected to said low pressure reservoir.

20. The method of claim 19 wherein said fuel injector includes a direct control needle valve that is movably positioned in said injector body; and including a step of exposing a closing hydraulic surface of said direct control needle valve to fluid pressure in said second fluid passage.

* * * * *